US006775912B2

(12) United States Patent
Panfili et al.

(10) Patent No.: US 6,775,912 B2
(45) Date of Patent: Aug. 17, 2004

(54) BLADE SCRAPING TOOL

(75) Inventors: François Panfili, Berthierville (CA); Jean-Pierre Panfili, Berthierville (CA)

(73) Assignee: A. Richard Ltée, Berthierville (CA)

( * ) Notice: Subject to any disclaimer, the term of this patent is extended or adjusted under 35 U.S.C. 154(b) by 0 days.

(21) Appl. No.: 10/057,684

(22) Filed: Jan. 24, 2002

(65) Prior Publication Data

US 2003/0136005 A1 Jul. 24, 2003

(51) Int. Cl.[7] ..... A47L 13/08; B26B 1/08; B26B 29/02

(52) U.S. Cl. ..... 30/169; 30/162; 30/335; 15/236.01

(58) Field of Search ..... 30/169, 335, 320, 30/162; 15/236.01

(56) References Cited

U.S. PATENT DOCUMENTS

| | | | | | |
|---|---|---|---|---|---|
| 3,964,162 | A | | 6/1976 | Gerson et al. | 30/162 |
| 4,558,517 | A | * | 12/1985 | Gringer | 30/169 |
| 4,712,269 | A | | 12/1987 | Worthen | 15/236 R |
| 4,890,351 | A | | 1/1990 | Wilson | 15/236.01 |
| 4,955,138 | A | | 9/1990 | Henke et al. | 30/169 |
| 5,095,573 | A | | 3/1992 | Henke et al. | 15/105 |
| 5,107,593 | A | | 4/1992 | Hutchins | 30/346 |
| D346,319 | S | | 4/1994 | Lavallee et al. | D8/99 |
| 5,433,004 | A | * | 7/1995 | Thompson et al. | 30/169 |
| 5,435,064 | A | | 7/1995 | Brookfield | 30/169 |
| 5,713,232 | A | | 2/1998 | Hodge | 70/456 R |
| 5,996,231 | A | | 12/1999 | Roche et al. | 30/169 |
| 6,101,721 | A | * | 8/2000 | Medhurst | 30/169 X |
| 2002/0095737 | A1 | * | 7/2002 | Panfili et al. | 15/236.01 X |

* cited by examiner

*Primary Examiner*—Charles Goodman
(74) *Attorney, Agent, or Firm*—Collard & Roe, P.C.

(57) ABSTRACT

A blade scraping tool including a hand gripping casing formed of a top covering and a bottom covering; a resilient plate mounted inside the casing; a blade; a blade mounting device; and an interlocking assembly. The resilient plate is slidably movable along a longitudinal slot on the top covering by actuating a push button thereon to release engagement of the interlocking assembly. The interlocking assembly cooperates with the resilient plate and the top covering for locking the plate into different positions by actuating and sliding the push button; a first position where the blade is entirely retracted within the casing, a second position where the blade is exposed for scraping, and a third position where the blade is exposed far enough for mounting and removal of the blade from the blade mounting device. The tool preferably includes a peripheral elastomer rim along a portion of the periphery of the casing.

19 Claims, 12 Drawing Sheets

BLADE SCRAPING TOOL

FIELD OF THE INVENTION

The present invention relates to a blade scraping tool. More particularly, the present invention relates to an ergonomic blade scraping tool for scraping applications and the like, the blade scraping tool comprising an ergonomic hand gripping casing which is lightweight and easy to operate and which provides comfortable hand gripping. The blade scraping tool also has a long lasting logo.

BACKGROUND OF THE INVENTION

Blade scraping tools, such as single edge blade scrapers, are very well known in the art. They generally include a hand gripping casing having a top covering case and a bottom covering case, a resilient trigger assembly disposed within the casing, a finger actuating portion that is part of the trigger assembly and projects from the casing through an elongated slot on the top covering case, and a scraping blade secured at the front end of the trigger assembly. The trigger assembly usually includes projections biasedly inserted into apertures on the top covering case of the casing, so as to enable the blade scraper to be either in a blade loading/unloading position, a blade scraping position or a blade storing position.

A problem associated with these types of scrapers is that the casing usually consists of a substantially rectangular frame which is typically made out of metal. The shape, in addition to the choice of material, makes handling and holding of the scraper fairly difficult and strenuous, especially when employing the blade scraping tool during long periods of time. Therefore, it would be very useful to provide a blade scraping tool having an ergonomic hand gripping casing enabling comfortable hand gripping and handling of the blade scraping tool.

Another problem associated with the above-mentioned types of scrapers is that the extremities of the slot on the top covering case usually correspond to the blade storing position and the blade loading/unloading position, with the blade scraping position lying between. Because these three distinct positions are not clearly differentiated, it has been found that several users usually bypass the blade scraping position thinking intuitively that the blade scraping position is at the furthest end of the slot on the top covering case, diametrically opposed to the blade storing position. Hence, users will often inadvertently start using the scraper with the blade in the loading/unloading position, thinking that it is actually in the blade scraping position. This has resulted in damages to the blade scraper, damages to the surface being worked-on, and injuries to the users of such devices. Therefore, it would be very useful to provide a blade scraping tool devised for easier operation thereof, such as to reduce the occurrence of the above-mentioned misapts.

Another problem associated with the above-mentioned types of blade scraping tools is that the loading and the unloading of the scraping blade onto the scraping tool is quite difficult to perform and poses certain safety risks to the users of such blade scraping tools. Therefore, it would be very useful to provide a blade scraping tool enabling an easier and safer loading and unloading of the blade onto the blade scraping tool.

Yet another problem associated with the above-mentioned types of blade scraping tools is that they comprise several elaborate components which are intrinsically interconnected to one another, thereby making manufacturing of such blade scraping tools quite laborious and consequently quite costly. Therefore, it would be very useful to provide a blade scraping tool comprising a much simpler design enabling an easier and more cost-effective manufacturing thereof.

Known to the Applicants are the following American patents and industrial design which describe different blade scraping tools: U.S. Pat. Nos. Des. 346,319; 3,964,162; 4,712,269; 4,955,138; 4,890,351; 5,095,573; 5,107,593; 5,435,064; 5,713,232; and 5,996,231.

Although some of the above-mentioned patents or industrial design address the ergonomic aspect of blade scraping tools, none of them seem to disclose or even suggest a blade scraping tool which would overcome all of the above-mentioned problems associated with the prior art.

SUMMARY OF THE INVENTION

An object of the present invention is to provide a blade scraping tool which would satisfy some of the above-mentioned needs, and would thus be an improvement over the blade scraping tools known in the art.

In accordance with the present invention, the above object is achieved by a blade scraping tool comprising:

- a hand gripping casing having a front end and a rear end, said casing being formed of a top covering and a bottom covering connected to each other, said top and bottom coverings together defining an opening at the front end of the casing, the casing further including a slot extending centrally and longitudinally on the top covering, said slot having front and rear extremities;
- a resilient plate mounted inside the hand gripping casing, the plate being slidably movable along the casing and comprising a push button extending outwardly from the casing through the slot and being slidably movable therealong;
- a blade;
- blade mounting means on which the blade is mounted, the blade mounting means being affixed to a front end of the resilient plate and being positioned and devised to slide through the opening of the casing;
- interlocking means cooperating with the resilient plate and the top covering for locking the plate and the blade into a retracted position where the blade is entirely encased within the casing, the interlocking means further cooperating with the resilient plate and the top covering for locking the plate and the blade into an operating position where the blade is exposed through the opening of the casing for operation of the tool;
- wherein the retracted position is attained by actuating the push button onto a first position along the slot corresponding to the retracted position;
- wherein the operating position is attained by actuating the push button onto a second position along the slot corresponding to the operating position, the second position being closer to the front end of the casing than the first position; and
- wherein a blade release position is attained by actuating the push button onto a third position along the slot, said third position being closer to the front end of the casing than the second position and allowing mounting and removal of the blade to and from the blade mounting means.

Preferably, the blade scraping tool further comprises a peripheral elastomer rim mounted along a portion of a periphery of the casing formed by the top and bottom coverings.

Preferably also, the elastomer rim extends continuously along the periphery of the casing from a left side thereof to a right side thereof, while passing by the rear end of the casing.

The invention and its advantages will be better understood upon reading the following non-restrictive description of preferred embodiment thereof, made with reference to the accompanying drawings.

DETAILED DESCRIPTION OF PREFERRED EMBODIMENT OF THE INVENTION

Figure 1:
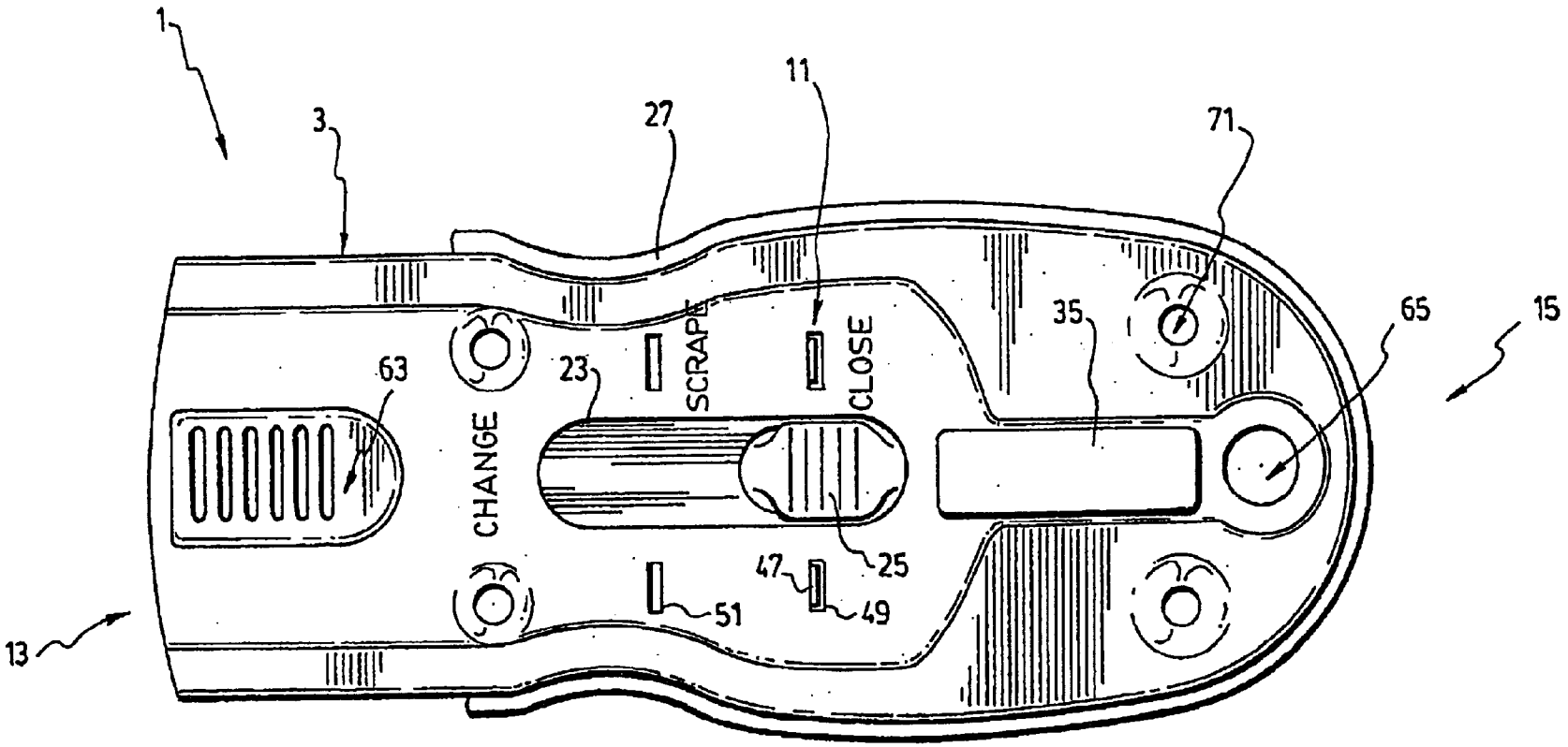
FIG. 1 is a top plan view of the blade scraping tool according to a preferred embodiment o the invention.

In the following description, the same numerical references refer to similar elements. The embodiments shown in the figures are preferred only.

Moreover, although the present invention as exemplified hereinafter was primarily designed for a blade scraping tool, it could be used with other objects and for other purposes, such as cutting tools for example, as apparent to a person skilled in the art. For this reason, expressions such as "scraping" and any other references and/or other expressions equivalent thereto should not be taken as to limit the scope of the present invention and include all other objects and all other applications with which the present invention could be used and may be useful.

Similarly, expressions such as "scraping" and "working", as well as any mutually equivalent expressions and/or compound words thereof, may be used interchangeably in the context of the present description. The same applies for any other mutually equivalent expressions, such as "scraper" and "scraping tool" and "retracted" and "stored" for example, as also apparent to a person skilled in the art.

In addition, although the preferred embodiment of the blade scraping tool as disclosed hereinafter comprises various components such as an elastomer rim, slots, grooves, lips, a blade with an extruded reinforcement edge, protrusions, support portions, holes, etc., which are useful and present several substantial advantages, not all of these components are essential to the invention and thus should not be taken in their restrictive sense, i.e. should not be taken as to limit the scope of the present invention. It is to be understood, as also apparent to a person skilled in the art, that other suitable components and cooperations thereinbetween may be used for the blade scraping tool according to the present invention, as will be described hereinafter, without departing from the scope of the invention.

Broadly described, the blade scraping tool 1 according to the preferred embodiment of the invention as it is illustrated in the accompanying drawings, is a blade scraping tool 1 comprising a hand gripping casing 3, a resilient plate 5 mounted inside the hand gripping casing 3, a blade 7, blade mounting means 9 on which the blade 7 is mounted, and interlocking means 11, as better shown in FIGS. 1 to 5.

Figure 2:
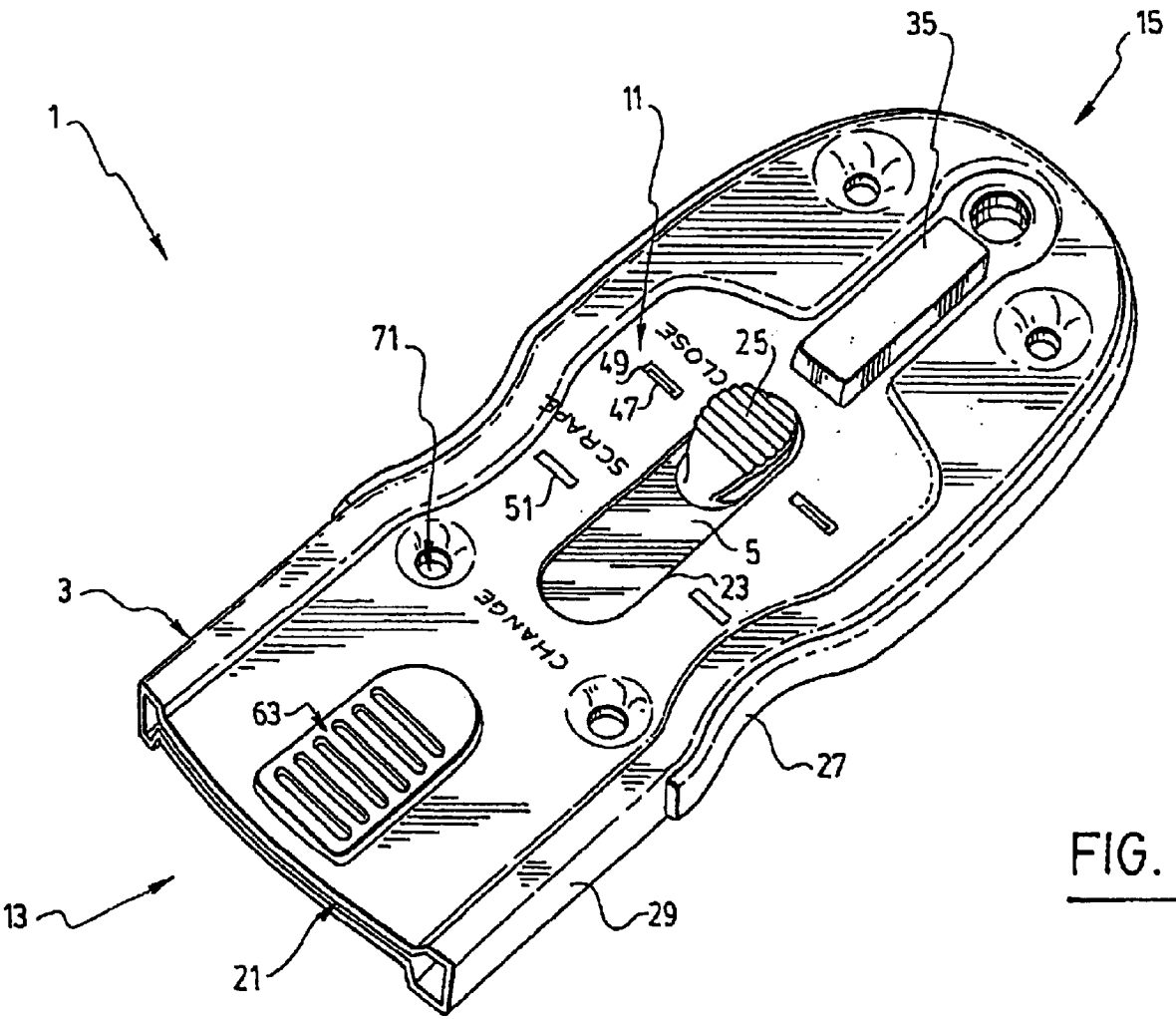
FIG. 2 is a top perspective view of the blade scraping tool shown in FIG. 1, said tool being shown with its blade in a retracted position.
Figure 9:
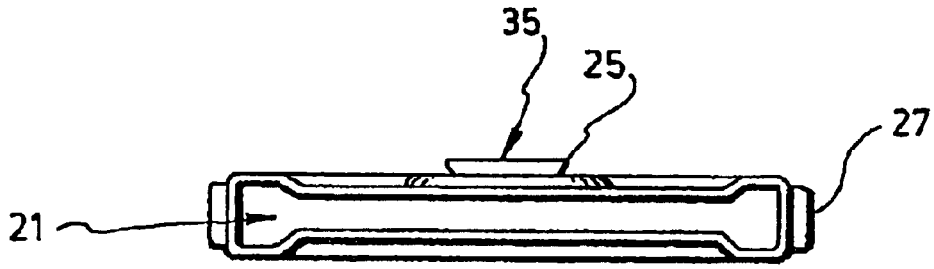
FIG. 9 is a front elevational view of the blade scraping tool shown in FIG. 1.
Figure 10:
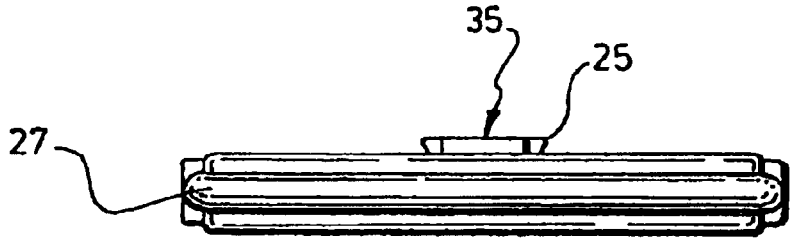
FIG. 10 is a rear elevational view of the blade scraping tool shown in FIG. 1.

The hand gripping casing 3 has a front end 13 and a rear end 15 and is formed of a top covering 17 and a bottom covering 19 connected to each other, the top and bottom coverings 17, 19 together defining an opening 21 at the front end 13 of the casing 3, as better shown in FIGS. 2 and 9. The casing further includes a slot 23 extending centrally and longitudinally on the top covering 17 and having front and rear extremities, as also shown in FIGS. 1–5.

The resilient plate 5 is mounted inside the hand gripping casing 3 and is slidably movable along the same. The resilient plate 5 comprises a push button 25 which extends outwardly from the casing 3 through the slot 23 and which is slidably movable therealong, as can be easily understood when comparing FIGS. 2–4.

Figure 3:
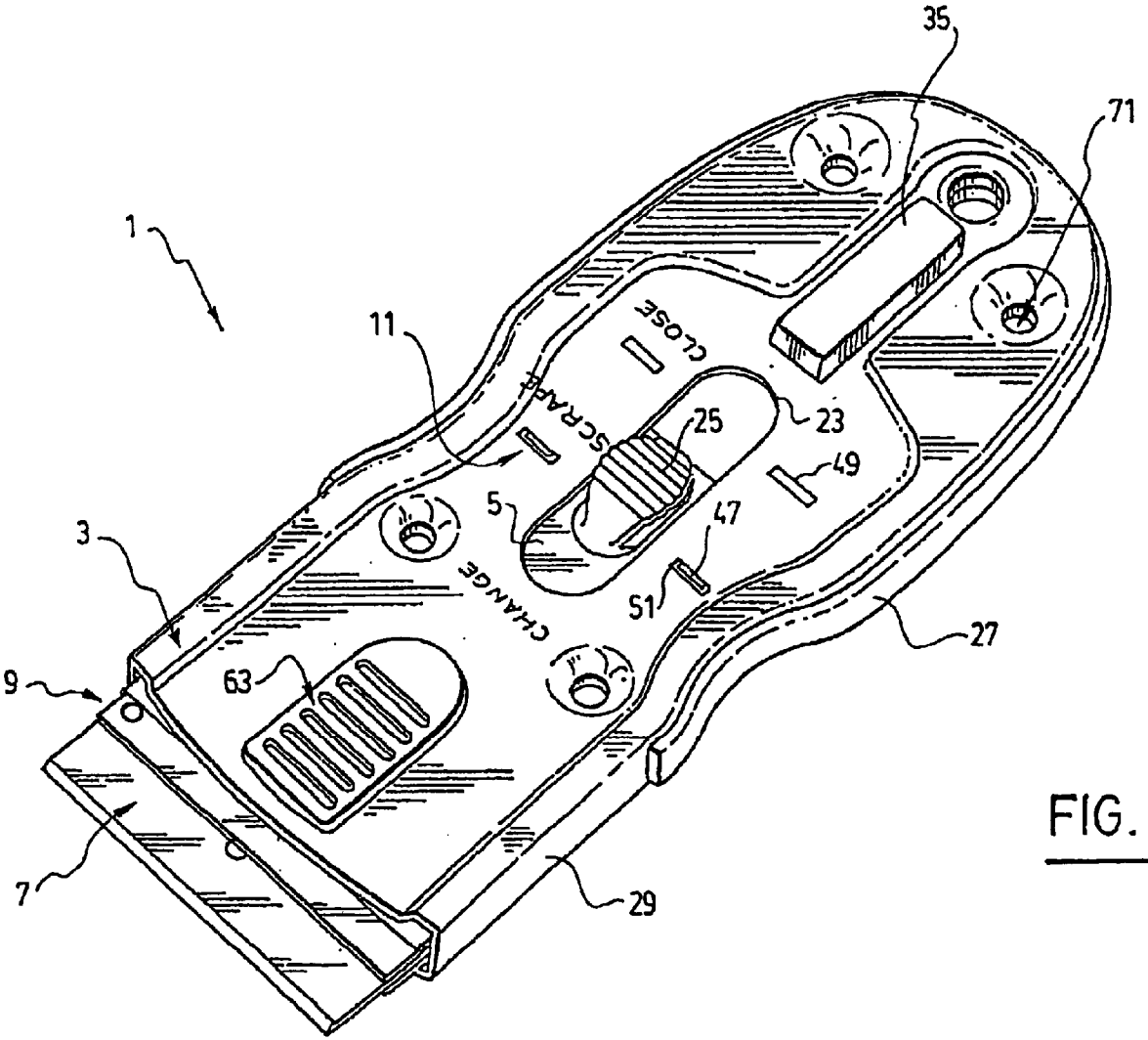
FIG. 3 is a top perspective view of the blade scraping tool shown in FIG. 1, said tool being shown with its blade in a scraping position.
Figure 4:
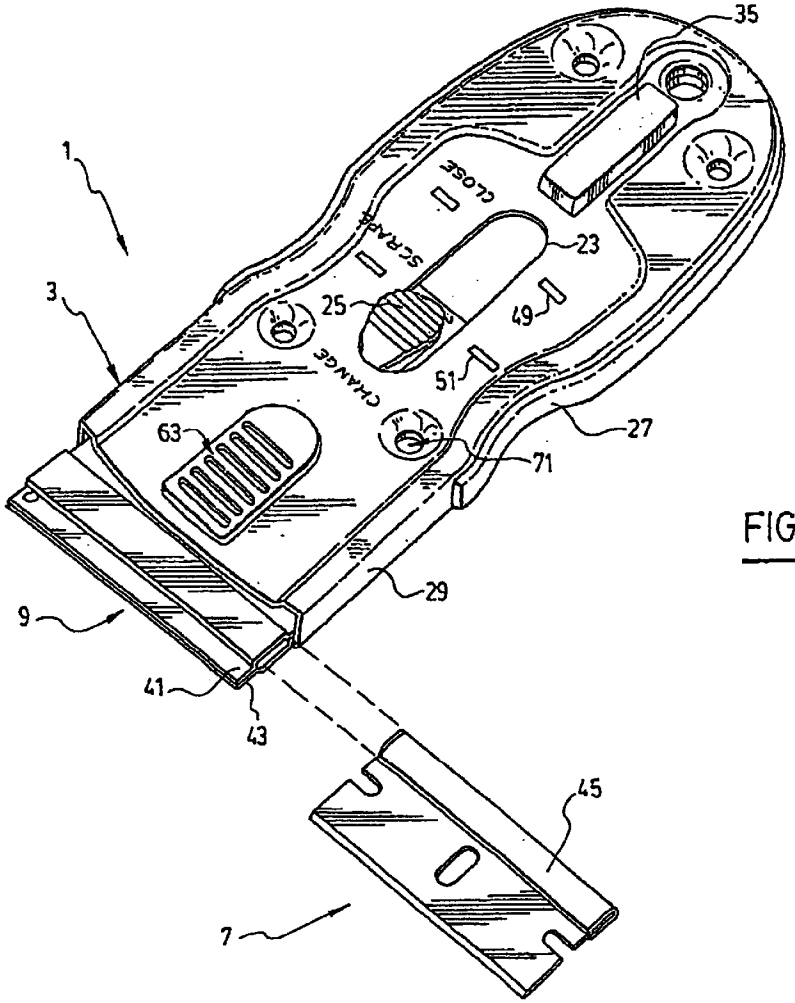
FIG. 4 is a top perspective view of the blade scraping tool shown in FIG. 1, said tool being shown with its blade in a blade release position.

The blade mounting means 9 on which the blade 7 is mounted are affixed to a front end of the resilient plate 5 and are positioned and devised to slide through the opening 21 of the casing 3, as shown in FIGS. 3 and 4.

The interlocking means 11 cooperate with the resilient plate 5 and the top covering 17 for locking the plate 5 and the blade 7 into a retracted position where the blade 7 is entirely encased within the casing 3. The interlocking means 11 further cooperate with the resilient plate 5 and the top covering 17 for locking the plate 5 and the blade 7 into an operating position where the blade 7 is exposed through the opening 21 of the casing 3 for operation of the tool 1.

As better shown in FIGS. 2 and 3, the retracted position is attained by actuating the push button 25 onto a first position along the slot 23 corresponding to the retracted position; whereas the operating position is attained by actuating the push button 25 onto a second position along the slot 23 corresponding to the operating position, the second position being closer to the front end 13 of the casing 3 than the first position.

A blade release position is attained by actuating the push button 25 onto a third position along the slot 23, this third position being closer to the front end 13 of the casing 3 than the second position and allowing mounting and removal of the blade 7 to and from the blade mounting means 9, as better shown in FIG. 4. It is to be understood that "blade release" position as used herein refers to either a "blade loading" position or a "blade unloading" position, as apparent to a person skilled in the art.

Figure 5:
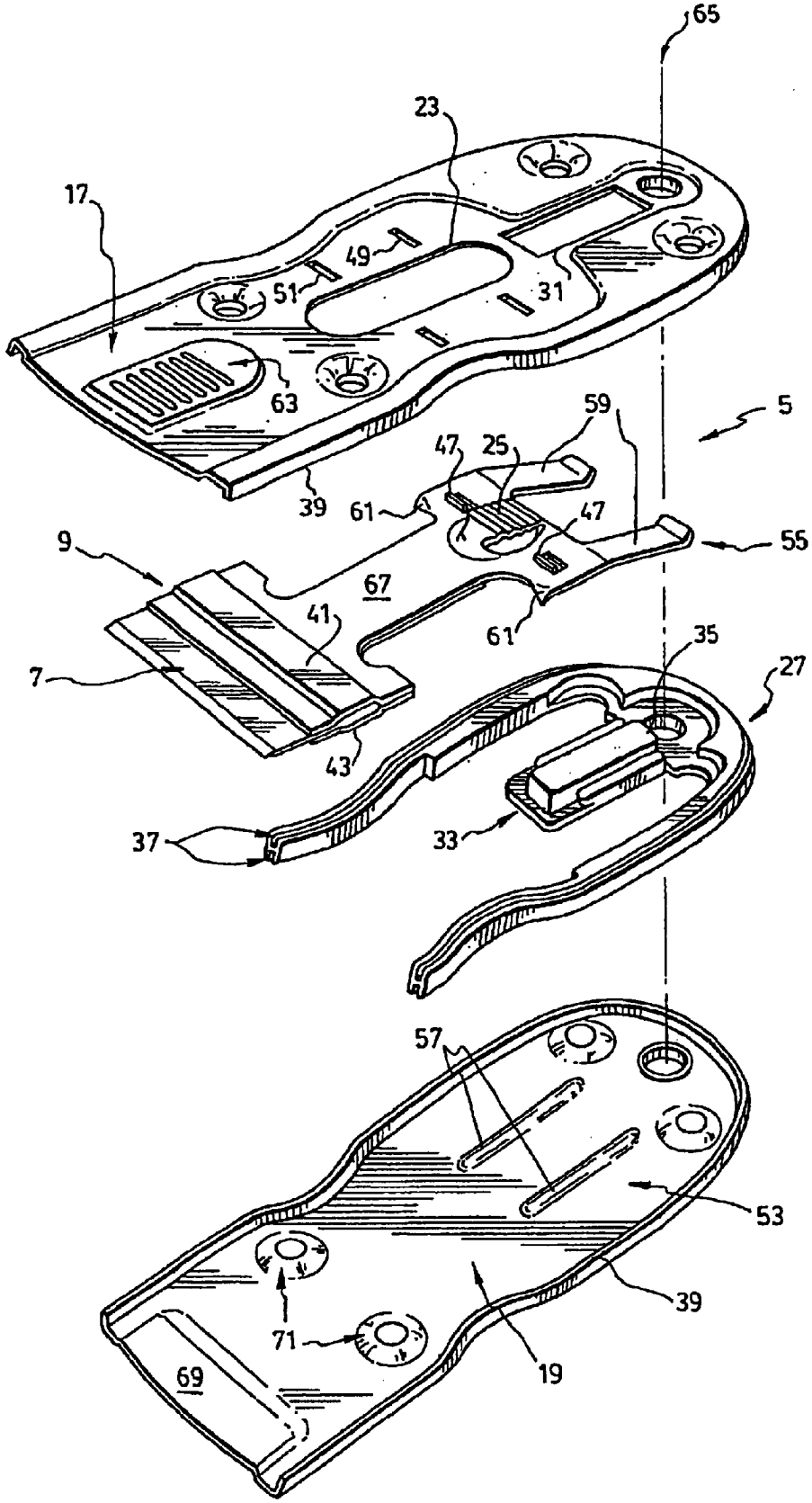
FIG. 5 is an exploded view of the blade scraping tool shown in FIG. 1.

As better shown in FIGS. 1 to 4, and particularly in FIG. 5, the blade scraping tool 1 preferably further comprises a peripheral elastomer rim 27 mounted along a portion of a periphery 29 of the casing 3 formed by the top and bottom coverings 17, 19. Preferably also, the elastomer rim 27 extends continuously along the periphery 29 of the casing 3 from a left side thereof to a right side thereof, while passing by the rear end 15 of the casing 3, as better shown in FIGS. 1–4, 13 and 14.

According to a particular preferred embodiment of the invention, the casing 3 further comprises a second slot 31 extending centrally and longitudinally on the top covering 17, adjacent to the rear end 15 of the casing 3. Preferably also, the elastomer rim 27 further comprises an internal portion 33 positioned inside the casing 3 and having a protruding tab 35, this tab 35 extending outwardly from the casing 3 through the second slot 31 when the top covering 17 is connected to the bottom covering 19 to form the casing 3, as better shown in FIGS. 1–5.

Figure 6:
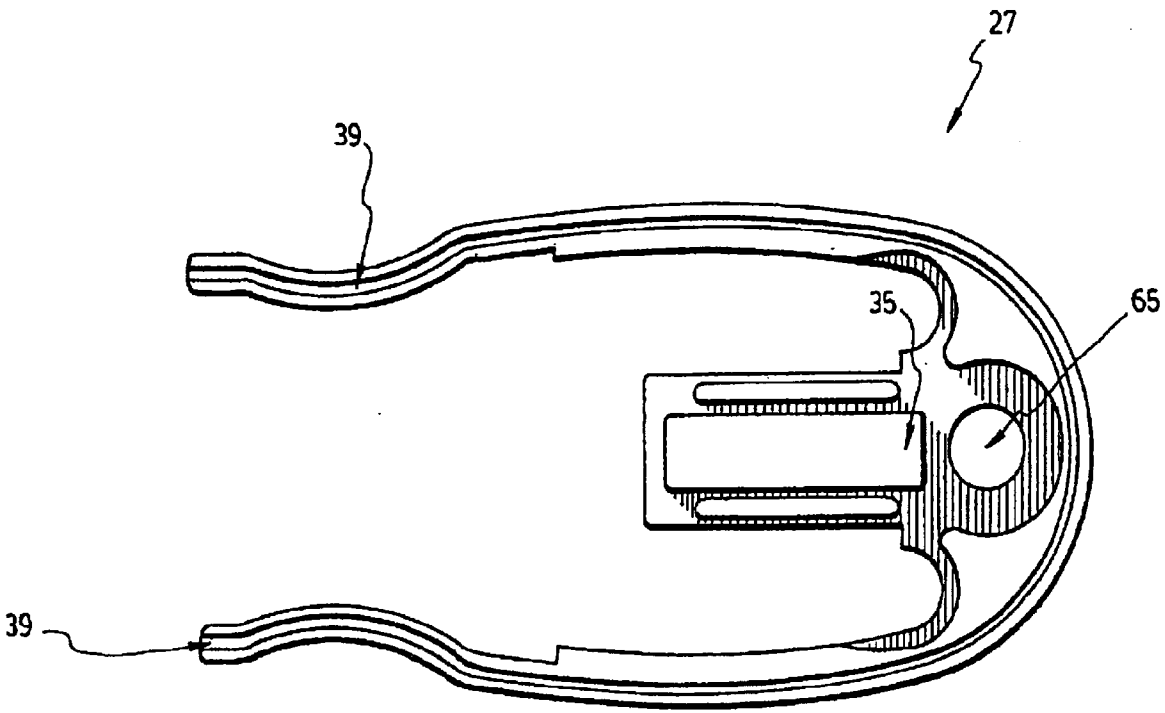
FIG. 6 is a top plan view of the elastomer rim shown in FIG. 5.

Referring now to FIGS. 5 and 6, the elastomer rim 27 is preferably provided with top and bottom grooves 37, said top and bottom grooves 37 being positioned and sized for receiving peripheral edges 39 of the top and bottom coverings 17, 19 respectively.

Figure 7:
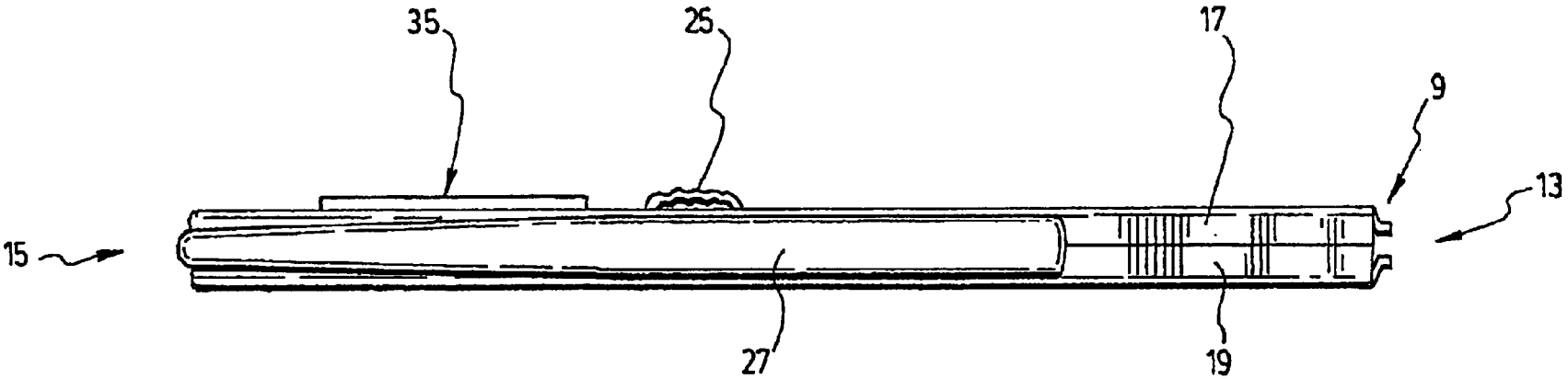
FIG. 7 is a right elevational side view of the blade scraping tool shown in FIG. 1.
Figure 8:
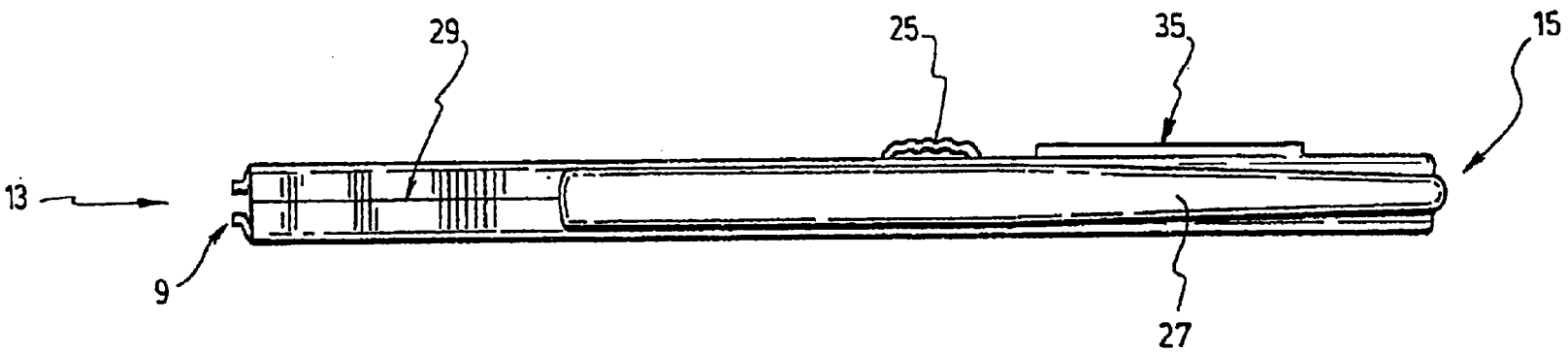
FIG. 8 is a left elevational side view of the blade scraping tool shown in FIG. 1.

As better shown in FIGS. 7 and 8, the peripheral elastomer rim 27 preferably has a width tapering off toward the rear end 15 of the casing 3. This is done preferably so as to have wider contact surfaces of the elastomer rim 27 at the portions of the casing periphery 29 (i.e. the sides thereof which are normally used to receive the fingers of a user of the tool 1 whereas the rear end 15 of the casing 3 is preferably provided with a narrower elastomer rim width so as to have a smaller contact area against another part of a user's hand, say the palm thereof for example. Once again, all these preferred features are a matter of construction and design and are used primarily to increase and optimize ergonomic handling of the blade scraping tool 1.

According to the preferred embodiment of the invention, the elastomer rim 27 is secured along the periphery of the casing 3 when the top and bottom coverings 17, 19 are affixed to one another and that their peripheral edges 39 are inserted into the respective grooves 37 of the elastomer rim 27, thereby clamping the same between the top and bottom coverings 17, 19, as can be easily understood from observing FIG. 5.

It is worth mentioning here that although the elastomer rim 27 is not absolutely essential for proper operation of the present invention, it nevertheless provides several advantages to the blade scraping tool 1. Indeed, among several advantages, the elastomer rim 27 when used with the blade scraping tool 1 according to the present invention enables for an improved and more comfortable hand manipulation and gripping of the casing 3 by a user of the tool 1. The user feels more in control of the tool 1 and the handling thereof is less strenuous than with the scraping tools of the prior art.

It is worth noting also that although the protruding tab 35 of the elastomer rim 27 is not an essential component thereof, it nevertheless provides substantial advantages in that the sign of a manufacturer of the tool 1, for example, may be disposed on the outer face of the protruding tab 35, as shown, for display through the second slot 31 of the casing 3. It is to be understood that the word "sign" is not to be taken in its restrictive sense since the sign may be selected from the group consisting of names, words, numbers, logos, trademarks and any other symbols conveying information or visual appeal. The same applies for the word "manufacturer" of the hand tool 1 which may refer to any particular party associated with the scraping tool 1, such as manufacturers, distributors, buyers, and the like.

Preferably also, the elastomer rim 27, the protruding tab 35 and the logo which may or may not appear on the protruding tab are integral to one another, i.e., are molded into one single piece from one single material, thereby enabling for a simple, quick, and inexpensive way of manufacturing the same. It can be easily understood that if a protruding tab 35 is not used with the elastomer rim, then the casing 3 of the scraping tool 1 need not necessarily be provided with a second slot 31, as apparent to a person skilled in the art. Furthermore, it is worth mentioning that the elastomer rim 27 may be affixed to the periphery 29 of the casing 3 by other suitable means different from those disclosed herein, such as by adhesively mounting the elastomer rim 27 to the periphery 29 of the casing 3, for example, if the elastomer rim 27 is deprived of its internal portion 33, as also apparent to a person skilled in the art.

Figure 11:
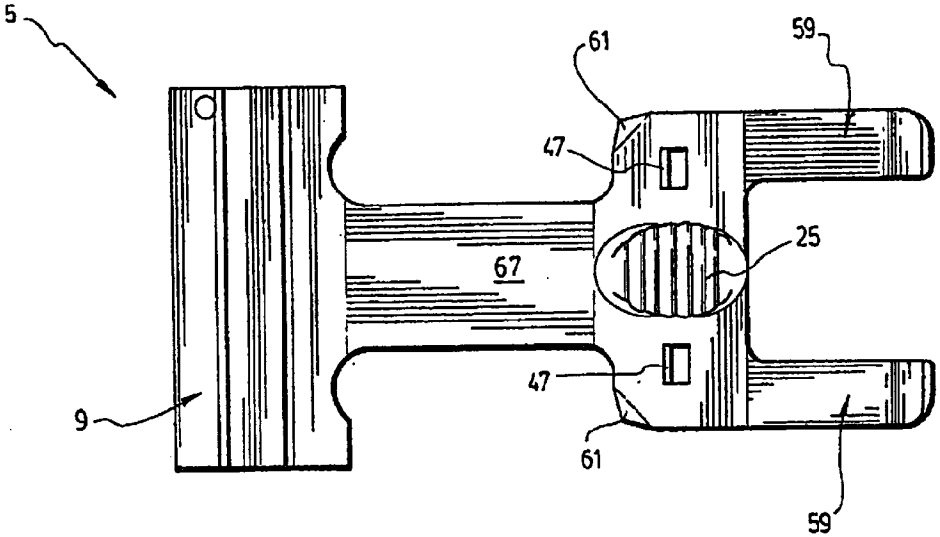
FIG. 11 is a top plan view of the resilient plate shown in FIG. 5.
Figure 12:
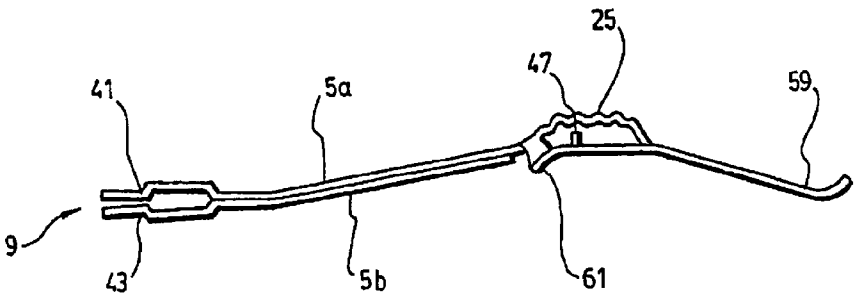
FIG. 12 is a side elevational view of the resilient plate shown in FIG. 11.
Figure 13:
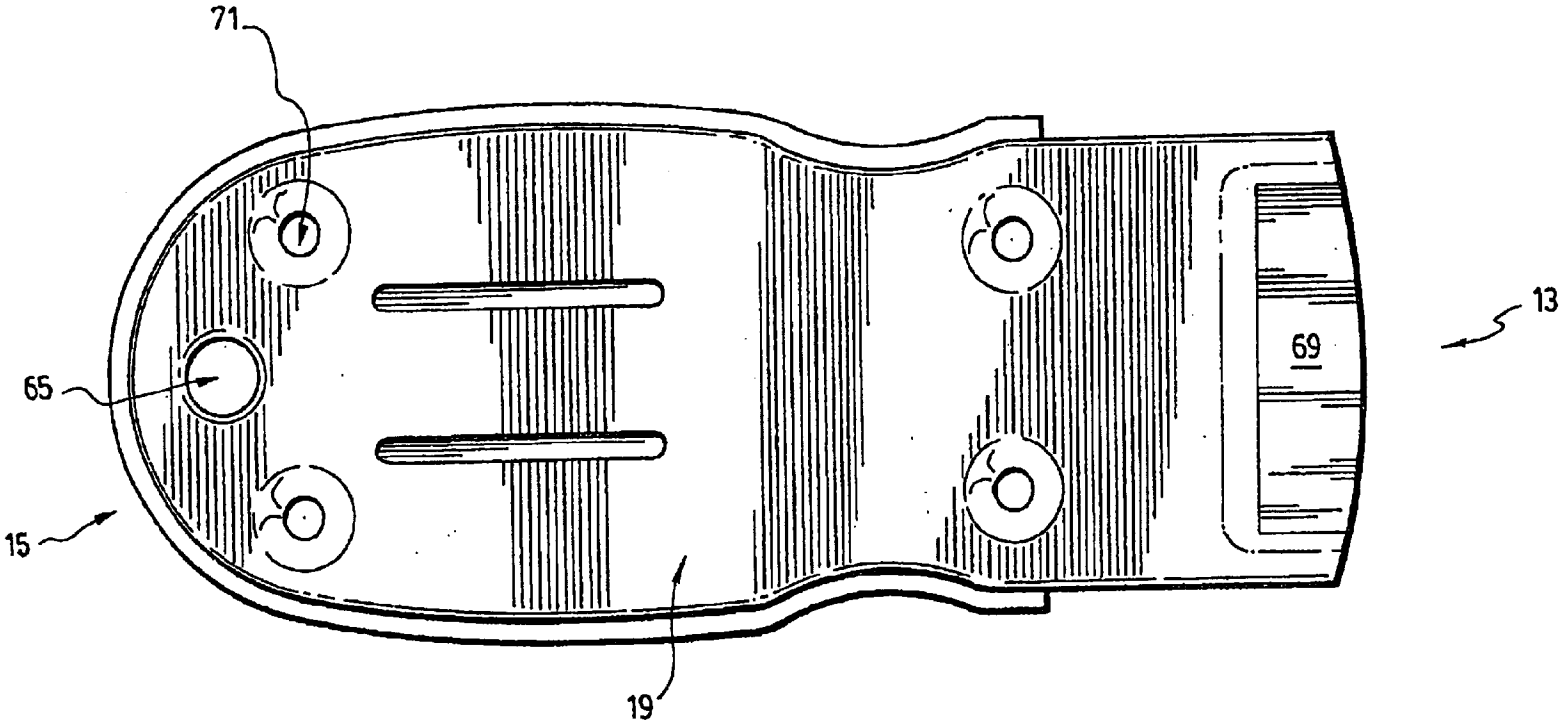
FIG. 13 is a bottom plan view of the blade scraping tool shown in FIG. 1.
Figure 14:
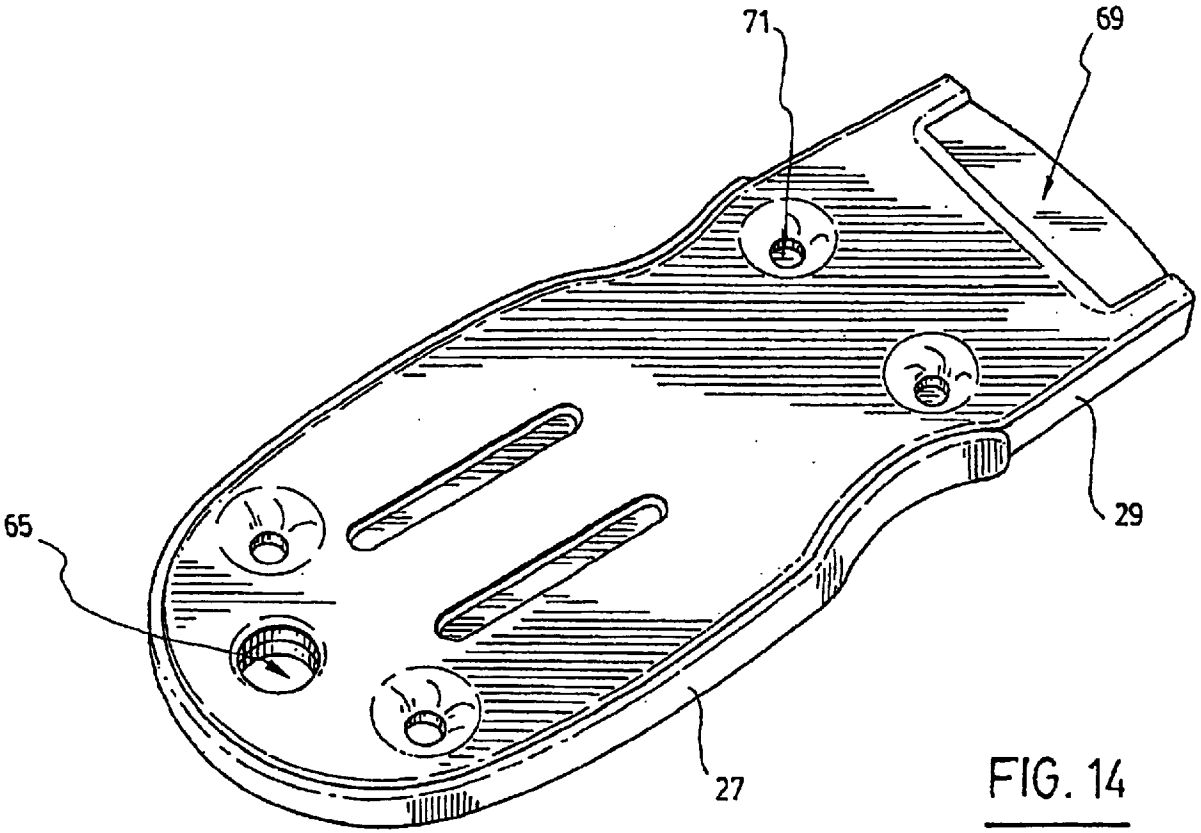
FIG. 14 is a bottom perspective view of the blade scraping tool shown in FIG. 1.

Referring now to FIGS. 4, 11 and 12, the blade mounting means 9 preferably comprise top and bottom lips 41, 43 for mounting the blade 7 thereinbetween, and the blade 7 comprises front and rear edges, the front edge being used for scraping while the rear edge being preferably provided with an extruded reinforcement 45, the extruded reinforcement 45 of the blade 7 being removably slidable between the top and bottom lips 41, 43 through a side opening defined by said lips 41, 43, as better shown in FIG. 12.

Referring back now to FIGS. 1–5, the interlocking means preferably comprises at least one protrusion 47 provided on the resilient plate 5, at least one first hole 49 provided on the top covering 17 of the casing 3, this at least one first hole 49 corresponding to the first position (the retracted position), and at least one second hole 51 provided on the top covering 17 of the casing 3, this at least one second hole 51 corresponding to the second position (the operating position). According to the preferred embodiment of the invention, each protrusion 47 is removably insertable by means of the push button 25 into each first hole 49 and each second hole 51 for locking the plate 5 and the blade 7 into the retracted and operating positions, respectively, as better shown when contrasting FIGS. 2 and 3. As can be easily understood, other suitable interlocking means may be used for ensuring a proper cooperation between the resilient plate 5 and the top covering 17 for operating the blade scraping tool 1 between three distinct modes, namely the retracted position, the operating position, and the blade release position, by means of an appropriate "push button", as apparent to a person skilled in the art.

According to the preferred embodiment of the interlocking means 11, two pairs of holes 49, 51 are used respectively for the retracted and operating positions, consequently two protrusions 47 are preferably used with the resilient plate 5 to ensure proper cooperation between the pair of protrusions 47 of the resilient plate 5 and the pairs of holes 49, 51 of the top covering 17. Preferably also, the third position along the slot 23 corresponding to the blade release position is not provided with corresponding holes, so as to clearly differentiate the blade release position from the retracted and operating positions. Another advantage of the third position (blade release position) not having corresponding holes is that when the blade 7 is slid onto the top and bottom lips 41, 43, then a user of the tool 1 may either use the push button 25 or simply, while holding the casing 3, push the mounted blade 7 against a given surface to "snap" the resilient plate 5 into the scraping position, thereby enabling for a quick, simple and safe loading of the blade 7 onto the scraping tool 1. When in the blade release position, the protrusions 47 of the resilient plate 5 are maintained against the internal surface of the top covering 17 due to the resiliency and the shape of the plate 5. Preferably also, the top covering 17 of the scraping tool 1 is provided with appropriately located indications, such as "CLOSE", "SCRAPE", and "CHANGE" for example, for further differentiating the retracted, operating, and blade release positions of the scraping tool 1. Other suitable indications, such as symbols for example, may be used for differentiating these different positions. Furthermore, in regards to the interlocking means 11, it has been found that a symmetrical arrangement of the components enables for a sounder structural integrity of the blade scraping tool 1.

Preferably and as better shown in FIGS. 5 and 11–14, the casing 3 comprises guiding means 53 and the resilient plate 5 comprises sliding means 55, the guiding means 53 of the casing 3 cooperating with the sliding means 55 of the resilient plate 5 for guiding the sliding of the resilient plate 5 within the casing 3. Preferably also, the guiding means 53 comprise two channels 57 protruding longitudinally inside the casing 3 from the bottom covering 19 and the sliding means 55 comprise two longitudinal skids 59, the channels 57 being disposed between the skids 59 for guiding the sliding of the resilient plate 5 within the casing 3. Once again, it is worth mentioning here that the guiding means 55 and sliding means 57 of the scraping tool 1 are not necessarily limited to the ones illustrated in the accompanying drawings, but that other suitable sliding means 57 and guiding means 55 may be used for ensuring proper cooperation between the resilient plate 5 and the casing 3, as also apparent to a person skilled in the art.

Preferably also, the resilient plate 5 comprises at least one reinforcement bend 61, as better shown in FIGS. 5, 11 and 12. Among many other uses, the reinforcement bend 61 is preferably used to prevent the resilient plate 5 from reaching its maximum elasticity limit when deformed, i.e. actuated, by a user pressing onto the push button 25, as apparent to a person skilled in the art. The reinforcement bend 61, depending on its length, may also serve as a stopper of the resilient plate 5 against the inner surface of the bottom covering 19, as also apparent to a person skilled in the art.

As better shown in FIGS. 11 and 12, the push button 25 of the resilient plate 5 is preferably provided with transversal grooves for facilitating actuation of the push button 25 by a user's finger. Preferably also, the top covering 17 further comprises a finger support portion 63, said finger support portion 63 extending centrally and longitudinally on the top covering 17, adjacent to the front end 13 of the casing 3, as better shown in FIGS. 1–5. The finger support portion 63 is preferably also provided with transversal grooves for increasing support of a finger of a user employing the blade scraping tool 1 and the casing 3 preferably comprises curved left and right peripheral sides for facilitating handling of the blade scraping tool 1 by a user thereof.

As also shown in FIGS. 1–5, the casing 3 preferably comprises an orifice 65 extending therethrough from the top covering 17 to the bottom covering 19, said orifice 65 being used for hooking the blade scraping tool 1 onto a hooking element (not shown). Similarly, the elastomer rim 27 preferably also has a corresponding orifice 65, as shown in FIGS. 5 and 6.

Preferably, the resilient plate 5 is made of a suitable material, such as metal for example, and preferably consists of two plates 5*a*, 5*b* affixed to one another. The first plate 5*a* is preferably cut from a sheet of material into a desired geometrical shape and then pressed against a suitable die, as apparent to a person skilled in the art, to obtain projections and punch marks which result into the push button 25, the interlocking protrusions 47, and the receiving groove of the top lip 41, as better shown in FIGS. 11 and 12. Similarly, a second plate 5*b*, without the sliding means 55 and the push button 25 assembly obviously, is cut and formed and then securely affixed to the first plate 5*a* by means of spot welding preferably. These spot welds preferably occur at suitable locations along the neck 67 of the resilient plate 5, as also better shown in FIGS. 11 and 12. Obviously, other suitable means may be used to affix the first plate 5*a* to the second plate 5*b*, as apparent to a person skilled in the art, or for forming the resilient plate 5 for that matter.

In a preferred manner similar to the above-mentioned, the top and bottom coverings 17, 19 are made of a suitable material, such as metal for example, and are preferably cut from a sheet of material into desired geometrical shapes. These cut plates are then pressed against suitable dies, as apparent to a person skilled in the art, to obtain appropriate projections and punch marks corresponding to the different components and desired geometrical configurations of the top and bottom coverings 17, 19 respectively, as better shown in FIG. 5. The finger support portion 63, the first and second slots 23, 31, the orifice 65, the holes 49, 51, as well as the other parts of the top covering 17 are preferably made in such a manner, so as to be preferably made integral to one another (one single piece made of one single material). The orifice 65, the guiding channels 57, the recessed portion 69, as well as the other parts of the bottom covering 19 are preferably made in the same way. As also apparent to a person skilled in the art, other suitable means and manufacturing methods may be used to fabricate the top and bottom coverings 17, 19. The top covering 17 is preferably connected to the bottom covering 19 by means of spot welding at appropriate recessed locations 71, as better shown in FIGS. 1–5. It is worth nothing though that other suitable fastening means may be used to securely affix both coverings 17, 19 onto one another, as apparent to a person skilled in the art, but that spot welding is a preferred way because it is namely a very quick, simple and inexpensive manner of securely adjoining both pieces together, and that no additional fasteners such as bolts, screws, and the like are required.

As may now be appreciated, the blade scraping tool 1 according to the present invention is an improvement over the prior art in that it provides an ergonomic hand gripping casing 3 enabling comfortable hand gripping and handling of the tool 1, as explained hereinabove. The blade scraping tool 1 according to the present invention is also advantageous in that it is devised for easy operation thereof, so as to reduce the occurrence of mishaps associated with the blade scraping tools of the prior art. The blade scraping tool 1 according to the present invention is also an improvement over the prior art in that it provides an easier and safer loading and unloading of the blade 7 onto the blade scraping tool 1, as can be easily understood from the present description. Furthermore, as detailed hereinabove, the blade scraping tool 1 according to the present invention is advantageous in that it has a much simpler design enabling an easier and more cost-effective manufacturing thereof when compared to the tools of the prior art.

Of course, numerous modifications can be made to the above-described embodiments without departing from the scope of the invention as described in the appended claims.

What is claimed is:

1. A blade scraping tool, said tool comprising:

a hand gripping casing having a front end and a rear end, said casing being formed of a top covering and a bottom covering connected to each other, said top and bottom coverings together defining an opening at the front end of the casing, said casing further including a slot extending centrally and longitudinally on the top covering, said slot having front aid rear extremities;

peripheral elastomer rim mounted along a portion of a periphery of the casing formed by the top and bottom coverings;

a resilient plate mounted inside the hand gripping casing, said plate being slidably movable along said casing and comprising a push button extending outwardly from the casing through the slot and being slidably movable therealong;

a blade;

blade mounting means on which the blade is mounted, said blade mounting means being affixed to a front end of the resilient plate and being positioned and devised to slide through the opening of the casing;

interlocking means cooperating with the resilient plate and the top covering for locking the plate and the blade into a retracted position where the blade is entirely encased within the casing, said interlocking means further cooperating with the resilient plate and the top covering for locking the plate and the blade into an operating position where the blade is exposed through the opening of the casing for operation of the tool;

wherein the retracted position is attained by actuating the push button onto a first position along the slot corresponding to the retracted position;

wherein the operating position is attained by actuating the push button onto a second position along the slot corresponding to the operating position, the second position being closer to the front end of the casing than the first position; and wherein a blade release position is attained by actuating the push button onto a third position along the slot, said third position being closer to the front end of the casing than the second position and allowing mounting and removal of the blade to and from the blade mounting means.

2. A blade scraping tool according to claim 1, wherein the elastomer rim extends continuously along the periphery of the casing from a left side thereof to a right side thereof, while passing by the rear end of the casing.

3. A blade scraping tool according to claim 1, wherein the casing further comprises a second slot extending centrally and longitudinally on the top covering, adjacent to the rear end of the casing, and wherein the elastomer rim further comprises an internal portion positioned inside the casing and having a protruding tab, said tab extending outwardly from the casing through the second slot when the top covering is connected to the bottom covering to form the casing.

4. A blade scraping tool according to claim 1, wherein the elastomer rim is provided with top and bottom grooves, said top and bottom grooves being positioned and sized for receiving peripheral edges of the top and bottom coverings respectively.

5. A blade scraping tool according to claim 1, wherein the peripheral elastomer rim has a width tapering off toward the rear end of the casing.

6. A blade scraping tool according to claim 1, wherein the blade mounting means comprise top and bottom lips for mounting the blade thereinbetween, and wherein the blade comprises front and rear edges, the front edge being used for scraping and the rear edge being provided with an extruded reinforcement, said extruded reinforcement of the blade being removably slidable between the top and bottom lips through a side opening defined by said lips.

7. A blade scraping tool according to claim 1, wherein the interlocking means comprises at least one protrusion provided on the resilient plate, at least one first hole provided on the top covering of the casing, said at least one first hole corresponding to the first position, and at least one second hole provided on the top covering of the casing, said at least one second hole corresponding to the second position, wherein said at least one protrusion is removably insertable by means of the push button into said at least one first hole and said at least one second hole for locking the plate and the blade into the retracted and operating positions, respectively.

8. A blade scraping tool according to claim 1, wherein the casing comprises guiding means and wherein the resilient plate comprises sliding means, the guiding means of the casing cooperating with the sliding means of the resilient plate for guiding the sliding of the resilient plate within the casing.

9. A blade scraping tool according to claim 8, wherein the guiding means comprise two channels protruding longitudinally inside the casing from the bottom covering and wherein the sliding means comprise two longitudinal skids, the channels being disposed between the skids for guiding the sliding of the resilient plate within the casing.

10. A blade scraping tool according to claim 1, wherein the resilient plate comprises at least one reinforcement bend.

11. A blade scraping tool according to claim 1, wherein the push button of the resilient plate is provided with transversal grooves for facilitating actuation of the push button by a user's finger.

12. A blade scraping tool according to claim 1, wherein the top covering further comprises a finger support portion, said finger support portion extending centrally and longitudinally on the top covering, adjacent to the front end of the casing.

13. A blade scraping tool according to claim 12, wherein the finger support portion is provided with transversal grooves for increasing support of a finger of a user employing the blade scraping tool.

14. A blade scraping tool according to claim 1, wherein the casing comprises curved left and right peripheral sides for facilitating handling of the blade scraping tool by a user thereof.

15. A blade scraping tool according to claim 1, wherein the casing comprises an orifice extending therethrough from the top covering to the bottom covering, said orifice being used for hooking the blade scraping tool onto a hooking element.

16. A blade scraping tool, said tool comprising:

a hand gripping casing having a front end and a rear end, said casing being formed of a top covering and a bottom covering connected to each other, said top and bottom coverings together defining an opening at the front end of the casing, said casing further including a slot extending centrally and longitudinally on the top covering, said slot having front and rear extremities;

a resilient plate mounted inside the hand gripping casing, said plate being slidably movable along said casing and comprising a push button extending outwardly from the casing through the slot and being slidably movable therealong;

a blade;

blade mounting means on which the blade is mounted, said blade mounting means being affixed to a front end of the resilient plate and being positioned and devised to slide through the opening of the casing;

interlocking means cooperating with the resilient plate and the top covering for locking the plate and the blade into a retracted position where the blade is entirely encased within the casing, said interlocking means further cooperating with the resilient plate and the top covering for locking the plate and the blade into an operating position where the blade is exposed through the opening of the casing for operation of the tool;

wherein the retracted position is attained by actuating the push button onto a first position along the slot corresponding to the retracted position;

wherein the operating position is attained by actuating the push button onto a second position along the slot corresponding to the operating position, the second position being closer to the front end of the casing than the first position;

wherein a blade release position is attained by actuating the push button onto a third position along the slot, said third position being closer to the front end of the casing than the second position and allowing mounting and removal of the blade to and from the blade mounting means;

wherein the tool further comprises a peripheral elastomer rim mounted along a portion of a periphery of the casing formed by the top and bottom coverings;

wherein the elastomer rim extends continuously along the periphery of the casing from a left side thereof to a right side thereof, while passing by the rear end of the casing;

wherein the blade mounting means comprise top and bottom lips for mounting the blade thereinbetween, and wherein the blade comprises front and rear edges, the front edge being used for scraping and the rear edge being provided with an extruded reinforcement, said extruded reinforcement of the blade being removably slidable between the top and bottom lips through a side opening defined by said lips; and wherein the interlocking means comprises at least one protrusion provided on the resilient plate, at least one first hole provided on the top covering of the casing, said at least one hole corresponding to the first position, and at least one second hole provided on the top covering of the casing, said at least one second hole corresponding to the second position, wherein said at least one protrusion is removably insertable by means of the push button into said at least one first hole and said at least one second hole for locking the plate and the blade into the retracted and operating positions, respectively.

17. A blade scraping tool according to claim 16, wherein the casing further comprises a second slot extending centrally and longitudinally on the top covering, adjacent to the rear end of the casing, and wherein the elastomer rim further comprises an internal portion positioned inside the casing and having a protruding tab, said tab extending outwardly from the casing through the second slot when the top covering is connected to the bottom covering to form the casing;

wherein the elastomer rim is provided with top and bottom grooves, said top and bottom grooves being positioned and sized for receiving peripheral edges of the top and bottom coverings respectively; and wherein the peripheral elastomer rim has a width tapering off toward the rear end of the casing.

18. A blade scraping tool according to claim 17, wherein the casing comprises guiding means and wherein the resilient plate comprises sliding means, the guiding means of the casing cooperating with the sliding means of the resilient plate for guiding the sliding of the resilient plate within the casing;

wherein the guiding means comprise two channels protruding longitudinally inside the casing from the bottom covering and wherein the sliding means comprise two longitudinal skids, the channels being disposed between the skids for guiding the sliding of the resilient plate within the casing;

wherein the resilient plate comprises at least one reinforcement bend; and wherein the push button of the resilient plate is provided with transversal grooves for facilitating actuation of the push button by a user's finger.

19. A blade scraping tool according to claim 18, wherein the top covering further comprises a finger support portion, said finger support portion extending centrally and longitudinally on the top covering, adjacent to the front end of the casing;

wherein the finger support portion is provided with transversal grooves for increasing support of a finger of a user employing the blade scraping tool;

wherein the casing comprises curved left and right peripheral sides for facilitating handling of the blade scraping tool by a user thereof; and wherein the casing comprises an orifice extending therethrough from the top covering to the bottom covering, said orifice being used for hooking the blade scraping tool onto a hooking element.

* * * * *